United States Patent [19]

Hauser et al.

[11] 4,415,084

[45] Nov. 15, 1983

[54] BLISTER PACKAGE

[75] Inventors: Ivo J. Hauser, White Plains, N.Y.; Bruno Lutz, Stamford, Conn.

[73] Assignee: The Nestle Company, Inc., White Plains, N.Y.

[21] Appl. No.: 332,499

[22] Filed: Dec. 21, 1981

[51] Int. Cl.[3] ..... B65D 75/36

[52] U.S. Cl. ..... 206/461; 206/467; 206/470

[58] Field of Search ..... 206/461, 470, 467, 628, 206/634; 229/2.5 R

[56] References Cited

U.S. PATENT DOCUMENTS

| | | | |
|---|---|---|---|
| 1,576,088 | 3/1926 | Bunz | 206/628 |
| 3,093,244 | 6/1963 | Middleton, Jr. et al. | 206/461 |
| 3,428,171 | 2/1969 | Blish | 206/461 |
| 3,948,391 | 4/1976 | Beaman | 206/461 |
| 4,200,193 | 4/1980 | Boyle | 206/470 |

*Primary Examiner*—William T. Dixson, Jr.
*Assistant Examiner*—Brenda J. Ehrhardt
*Attorney, Agent, or Firm*—Vogt and O'Donnell

[57] ABSTRACT

A blister package having two flanges. The flanges define supports for the package in angularly intersecting planes so that the package will stand stably in at least two different orientations. The opening of the blister may be arranged to provide access to the space within the blister from two sides, thus facilitating removal of the product from the blister.

14 Claims, 6 Drawing Figures

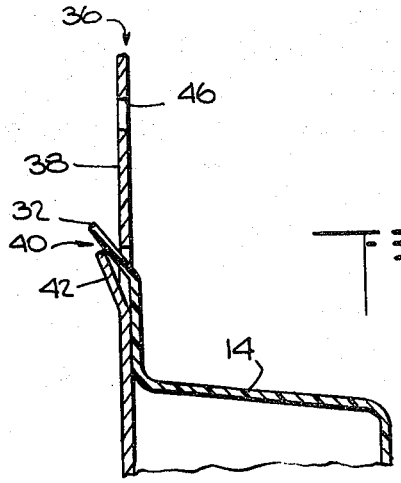
Fig. 3.
Fig. 8.
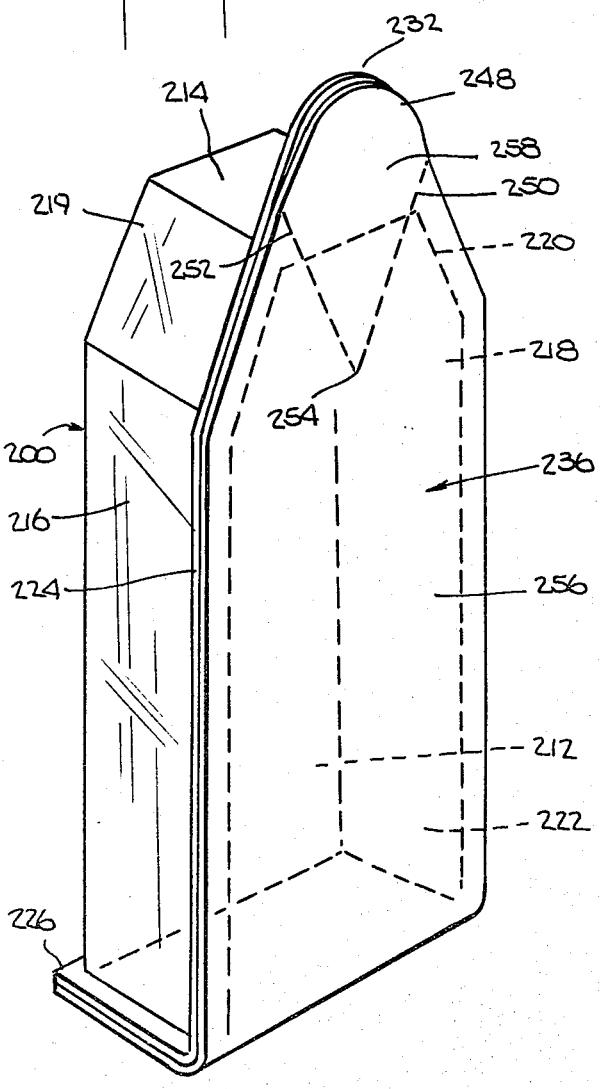
Fig. 5.
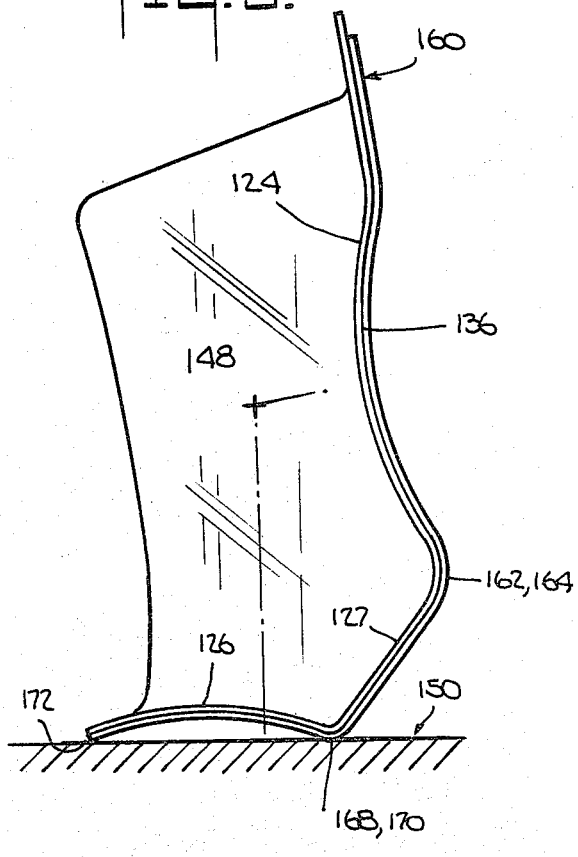

BLISTER PACKAGE

BACKGROUND OF THE INVENTION

The present invention relates to a package of the type commonly known as a blister package.

A "blister" is a unitary tray-like container formed by drawing a sheet material to the desired shape. A blister package includes a blister and a sheet-like cover attached to the blister so that the blister and the cover cooperatively enclose the product contained in the package. Such packages are economical because they are well suited to mass production methods. Moreover, the blister and the cover can be formed from a wide variety of readily available materials so that materials compatible with almost any product can be selected. Accordingly, blister packages have been widely utilized in an almost infinite variety of applications heretofore.

One problem which has limited the use of blister packages has been that the blister packages available heretofore have generally been suitable for storage or display on a shelf in only a limited number of orientations. Such packages generally incorporate a blister having wall portions defining a tub-like cavity open on one side and a single planar flange extending around the periphery of such opening. The sheet-like cover of the package is attached to this flange so that the cover closely overlies the flange and occludes the opening. Thus, the package will stand stably on a shelf with the cover facing down in contact with the shelf. Such packages are often incapable of standing on a shelf with the flange and cover in a vertical plane. In such an orientation, only an edge of the flange rests on the shelf and such edge does not offer a stable support.

Some of the blister packages available heretofore have been provided with holes in their flanges or covers for engagement with a peg or hook of a display rack. Although a blister package with such a hole can be hung on a rack with its flange and cover in vertical orientation, the necessary rack may not be available where the package is to be displayed.

The limitations of the blister packages generally available heretofore as to orientation on a shelf have posed significant problems, especially with respect to blister packages intended for retail sale in self-service stores. Presentation of such packages in appealing, eye catching disposition is important to consumer acceptance. Also, shelf space limitations may require different orientations in different stores.

SUMMARY OF THE INVENTION

The present invention provides a blister package which will stand stably on a shelf in a plurality of different orientations.

A package according to the present invention includes a blister having an opening and two flanges which bound the opening. Each of the flanges defines a planar support for the package. Th two flanges, however, are not co-planar. Rather, they are arranged so that the planes of the supports defined by the respective flanges angularly intersect one another. A sheet-like cover closely overlies both of the flanges and overlies the opening so that the cover and the blister cooperatively enclose the product in the package.

As used in this disclosure, the term "planar support" means at least three points disposed in a common plane and accessible for simultaneous contact with a planar surface, such points being arranged so that a line extending from the center of gravity of the package perpendicular to such plane would pass through a theoretical polygon having such points as it corners. As the cover in the package of the present invention closely overlies the flanges, the portion of the cover overlying each flange will conform to the shape of such flange. Thus, if a particular flange defines a planar support, the portions of the cover overlying such flange will also define such a support. Such support will provide a stable base for the package when the package is placed on a horizontal shelf so that the points constituting the support bear on the shelf.

As the flanges of the package define two such supports in angularly intersecting planes, the package can stand stably in either of two different orientations. The two flanges may be arranged so that edge portions of both flanges cooperate to define one or more additional planar supports in additional planes thereby providing even more stable orientations for the package.

Other objects, features and advantages of the present invention will be more readily apparent from the detailed description of the preferred embodiments set forth below taken in conjunction with the accompanying drawings.

BRIEF DESCRIPTION OF THE DRAWINGS

FIG. 3 is a schematic sectional view on an enlarged scale illustrating a portion of the package shown in FIG. 2.

FIG. 5 is a schematic view illustrating a package incorporating the blister of FIG. 4.

FIG. 6 is a perspective view illustrating a package according to a third embodiment of the present invention.

DETAILED DESCRIPTION OF THE PREFERRED EMBODIMENTS

Figure 1:
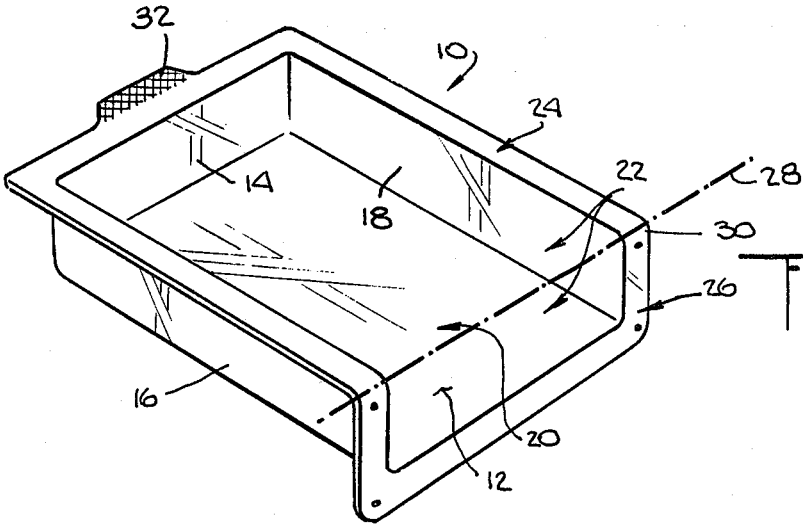
FIG. 1 is a perspective view of a blister for use in a package according to a first embodiment of the present invention.

As illustrated in FIG. 1, a blister 10 for use in one embodiment of the present invention is a unitary structure formed from a single piece of transparent thermoplastic material. The blister incorporates a front wall 12, an end wall 14 and two side walls 16 and 18 which cooperatively define an interior volume or pocket 20 having the shape of a rectangular solid. The blister has an opening 22 extending over two faces of interior volume 20. That is, opening 22 extends over the face of interior volume 20 opposite from end wall 14 and over the face of the interior volume opposite from front wall 12. A first U-shaped planar flange 24 bounds opening 22 on the side of the blister opposite from front wall 12 and a second U-shaped planar flange 26 bounds the opening on the side of the blister opposite from end wall 14. The plane of flange 24 is perpendicular to the plane of flange 26. Those portions of the flanges corresponding to the tips of their respective U-shapes intersect on another at an edge 28 o the blister, such portions merging with one another to form a chamber or fillet 30 at such edge. Flange 24 is provided with a tab 32 at the portion of the flange corresponding to the base of its U-shape, remote from flange 26.

Figure 2:
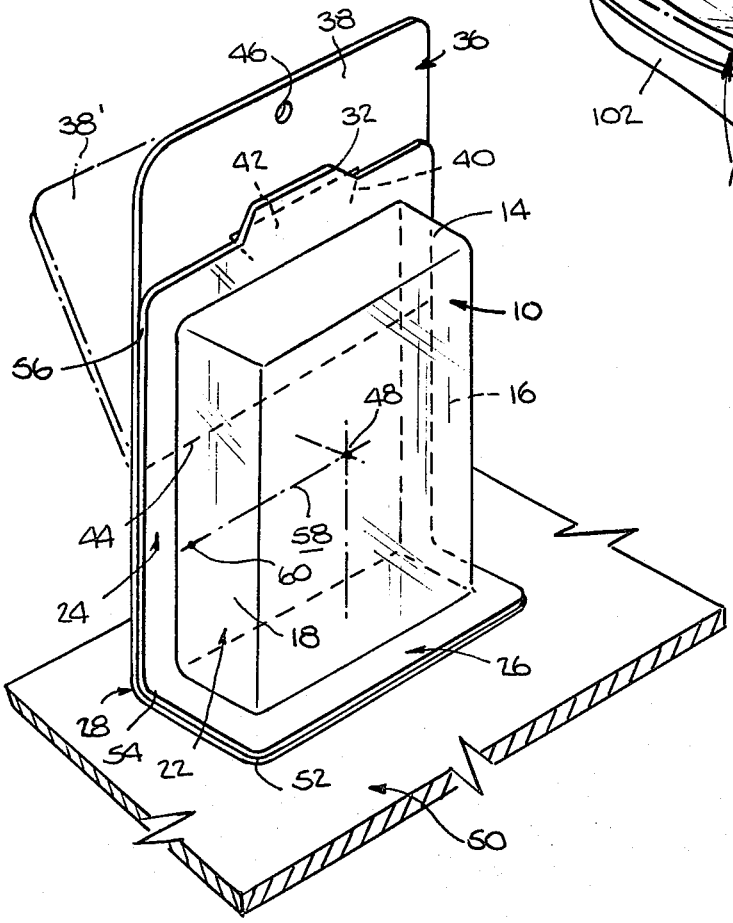
FIG. 2 is a perspective view of a package incorporating the blister illustrated in FIG. 1.

As illustrated in FIG. 2, the complete package includes the blister 10 and a sheet-like cover 36. Cover 36 closely overlies flanges 24 and 26 of the blister and overlies the opening 22 of the blister, the cover extending around edge 28. A coating of thermoplastic material is provided on the face of the cover which is in contact with the blister. This coating is releasably bonded to the flat surfaces of the flanges and secures the cover to the blister so that the cover may be peeled away from the blister. The coating is not bonded to tab 32. A portion 38 of the cover protrudes beyond tab 32 so that the tab and the protruding portion of the cover may be grasped to initiate the peeling operation. Cover 36 is also provided with a generally U-shaped tear line or cut 40 defining a bendable tab 42 adjacent tab 32 of the blister. A further score or perforation line 44 extends across cover 36 between tab 32 and edge 28 of the blister. A hole 46 extends through portion 38 of the cover remote from flange 26 of the blister.

The package illustrated in FIG. 2 will stand on a horizontal shelf in a variety of orientations. The cover portion overlying each flange of the blister provides a planar support for the package. As illustrated in FIG. 2, a theoretical line drawn from the center of gravity 48 of the package perpendicular to the plane of flange 26 intersects the plane of the flange at a point within the boundaries of the flange. Thus, when the package is placed on a horizontal shelf 50 so that the portions of cover 36 overlying flange 26 bear on such shelf, the package will stand upright as shown. Likewise, a line drawn from center of gravity 48 perpendicular to the plane of flange 24 will intersect that plane within the flange so that the package will also stand stably on a horizontal shelf if placed with flange 24 facing down and flange 26 extending vertically.

The two flanges cooperatively define an additional planar support in a plane perpendicular to the planes of the flanges themselves. Points 52 and 54 on an edge of flange 26 are co-planar with point 56 on an edge of flange 24. A line 58 drawn from the center of gravity 48 perpendicular to the plane of points 52, 54 and 56 will intersect such plane at a point 60 within the imaginary triangle having points 52, 54 and 56 as its vertices. Thus, the package will stand stably if placed on a horizontal shelf with both flanges extending in vertical planes and points 52, 54 and 56 resting on the shelf. The opposite edges of the flanges similarly define another planar support for the package on the side adjacent sidewall 18.

As will be readily appreciated, the package ilustrated in FIG. 2 can be displayed in numerous orientations as required by the particular merchandising situation. The hole 46 in cover 38 permits the package to be displayed hanging from a pin or hook inserted through the hole.

A noted above, the package may be opened by grasping projecting portion 38 of cover 36 and tab 32 of blister 10 and pulling the cover away from the blister so as to break the bond therebetween. Because the cover is relatively stiff, the cover tends to fold at score line 44 during this peeling action, so that protruding portion 38 and the adjacent portions of the cover swing to the position illustrated in broken lines at 38' in FIG. 2. In this position, a portion of opening 22 adjacent end wall 14 is uncovered so that the contents of the package are accessible. Such partial access is sufficient if the package contains numerous small articles or a powdery substance which can be removed through the uncovered portion of the opening.

If the user removes only part of the contents of the package, it may be desirable to temporarily reattach the cover and temporarily retain it in its original position relative to the blister. This may be accomplished by swinging the peeled-away portion of cover 36 back to its original position and pushing tab 42 of the cover away from the blister so as to part the cover along tear line 40, thus creating an opening through cover 36 adjacent tab 32. Tab 32 may then be flexed slightly and inserted through the opening so that the edge of the tab lies on the opposite side of cover 36 from the remainder of the blister as illustrated in FIG. 3. In this position, the tab retains the cover in its original position.

Figure 4:
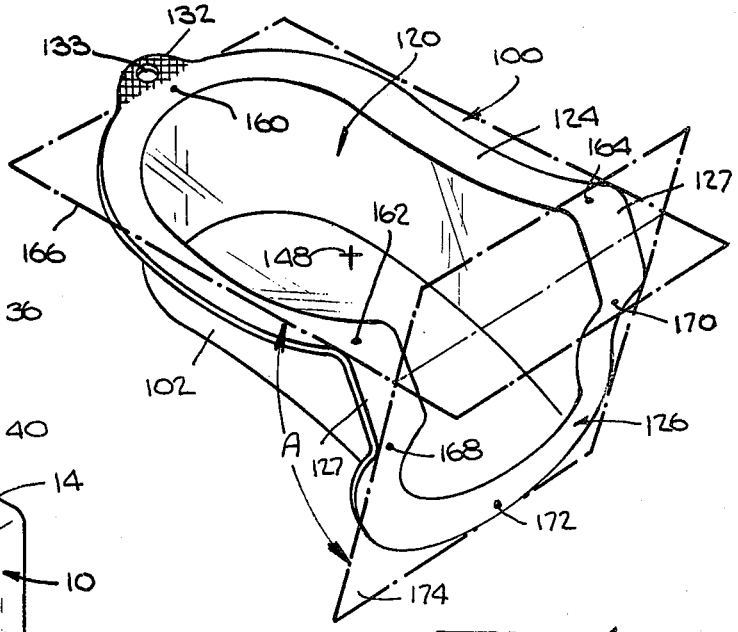
FIG. 4 is a perspective view similar to FIG. 1 but depicting a blister for use in a package according to a second embodiment of the present invention.

A blister for use in a package according to a second embodiment of the present invention is illustrated in FIG. 4. Such blister 100 has a wall structure 102 of irregular shape defining an irregularly shaped cavity or interior volume 120 and an opening extending over two faces of such interior volume. Two flanges 124 and 126 extend outwardly from wall structure 102 at the periphery of the opening. Unlike the flanges of the blister described above, flanges 124 and 126 are not planar, and these flanges do not intersect one another. Rather, a pair of connecting flanges 127 extends between the adjacent portions of flanges 126 and 124 at one edge of the blister. Flange 124 is provided with a tab 132 having a roughened surface, such tab being formed at the end of the blister opposite from flange 126. A hole 133 is formed in tab 132.

Although flanges 124 and 126 are not planar, each such flange defines a planar support for the package. Points 160, 162 and 164 on the surface of flange 124 are coplanar with one another, the common plane of such points being schematically indicated in broken lines at 166. Points 162, 160 and 164 are accessible for simultaneous contact with a common supporting planar structure and such points are so arranged that a line drawn from the center of gravity 148 of the package perpendicular to plane 166 will pass through the imaginary triangle having these points as its vertices. Likewise, points 168, 170 and 172 on the surface of flange 126 define a planar support for the package. The plane of this support (the common plane of points 168, 170 and 172) is schematically illustrated in broken lines at 174. The planes 166 and 174 of the two supports angularly intersect one another, the angle A between such planes being illustrated in FIG. 4.

As illustrated in FIG. 5, the finished package includes a cover 136 closely overlying and conforming to fanges 124 and 126 and also closely overlying intermediate flanges 127. The package will stand stably on a horizontal shelf 150 if placed with the portions of the cover overlying points 168, 170 and 172 of flange 126 bearing on the shelf. The package will also stand stably in a different orientation if placed with flange 124 facing downwardly so that the portions of cover 136 overlying points 164, 162 and 160 bear on the shelf.

Cover 136 is provided with a tab overlying tab 132 of the blister, and the cover is also provided with a hole (not shown) in registration with hole 133 in the tab. Thus, this package may also be displayed hanging from a peg inserted through the holes. The cover is releasably secured to the flanges of the blister by a peelable layer of thermoplastic material incorporated in the cover. Such layer does not adhere to the rough surface of tab 132 in the area of the cover. The non-adhering areas of the tab and cover permit the user to initiate separation and peel the cover away from the blister. The user may peel the cover entirely away from the blister, thus exposing the entire opening of the blister and, giving access to the internal space 120 within the blister from two sides.

Such access is a significant advantage, especially when the product contained in the package is a single unitary item. Because the product is accessible from two sides once the package has been opened, the product can readily be withdrawn from the blister. For example, the user of the package may insert a finger through the portion of the blister opening bounded by flange 126 and engage the end of the product adjacent such flange. Upon such engagement, the user can force the product upwardly through the portion of the opening bounded by flange 124. There is no need to provide any substantial clearance between the product and the walls of the blister to facilitate removal. By contrast, conventional blister packages in which the product is accessible from only one side upon opening often must be provided with sufficient clearance between the product and the blister wall to permit the user to insert a finger therebetween in order to extract the product. For a given product, the package according to the present invention can be made smaller than a comparable conventional package having such clearances.

The cover need not be entirely removed from the blister to provide the improved access described above. For example, the cover can be permanently fixed to the blister at the juncture of each connecting flange 127 with flange 126, and a tab similar to tab 132 can be provided at the edge of flange 126 remote from connecting flanges 127. With this arrangement, the user can peel the cover away from flange 124 and peel the cover away from flange 126 in a separate motion without removing the cover from the blister. After opening the package in this manner, the user can insert a finger through the portion of the blister opening bounded by flange 126 and force the product through the portion of the opening bounded by flange 124. Because the cover remains attached to the blister after opening, the user need not dispose of two separate items.

A package according to a third embodiment of the present invention as illustrated in FIG. 6, includes a blister 200 which has wall structure including a front wall 212, an end wall 214 and a pair of opposed parallel side walls 216 and 218. A pair of sloping intermediate walls 219 and 220 extend from side walls 216 and 218, respectively, to end wall 214. The side walls, intermediate walls, end wall and front wall of blister 200 cooperatively define the interior space of the blister. Such interior space is narrower at the end of the blister adjacent wall 214 than at the opposite end. The blister has a pair of planar, mutually perpendicular flanges 224 and 226 which bound the opening 222 of the interior space. Flange 226 is disposed at the end of the blister opposite from end wall 214, and flange 224 extends from flange 226 to the vicinity of end wall 214. A tab 232 is formed as an extension of flange 224 and projects beyond end wall 214.

The package also includes a cover 236 which closely overlies flanges 224 and 226 and which overlies the opening 222 of the blister so that the cover, cooperatively with the blister, completely encloses the space within the blister. The portion 248 of the cover which overlies the projecting tab 232 of the blister is not attached to the tab so that such portion of the cover may be grasped by the user. Cover 236 is provided with a pair of perforation lines 250 and 252 which extend from opposite edges of the cover adjacent portion 248 to a common juncture point 254. Perforation lines 250 and 252 thus subdivide cover 236 into a major portion 256 and a minor portion 258, which includes the portion 248 overlying blister tab 232.

In use, blister tab 232 and overlying portion 248 of the cover may be grasped and peeled apart. Cover 236 will part along perforation lines 250 and 252, so that the major portion 256 of cover 236 will remain in place, but the minor portion 258 will be removed. Such removal forms a hole in cover 236 at the end of the package opposite from flange 226. The contents of the package will thus be accessible through the portion of such hole overlying the opening of the blister; i.e., the portion of the hole in the cover disposed between juncture point 254 and end wall 214.

The package illustrated in FIG. 6 is especially useful for packaging and dispensing a powder or liquid. The hole in the cover formed by removal of minor portion 258 serves as a pouring spout for discharging a relatively narrow stream of the product from the package. Sloping intermediate walls 219 and 220 serve to guide the material toward such hole during pouring to minimize hold-up or retention of the product in the package. Because the discharge hole is disposed at the opposite end of the package from flange 226, the package can be stored in the position illustrated in FIG. 6 after the package has been opened and a portion of the material contained therein has been discharged. In this position, with flange 226 at the bottom, the hole is disposed adjacent the top of the package at an elevation higher than the level of product remaining in the package.

Other arrangements can be utilized to provide a similar hole in the cover. For example, one of the perforation lines 250 or 252 may be replaced by a score line so that upon opening minor portion 258 of the cover will be folded rather than entirely removed. A tab and slot similar to that illustrated in FIG. 3 may be provided for temporarily retaining the minor portion of the cover in its closed position. Alternatively, a hole may be preformed in cover 236 adjacent end wall 214 of the blister and a separate closure may be releasably attached to the cover overlying the hole. In this arrangement, the closure would be removed from the cover to gain access to the contents.

As will be readily appreciated, the packages illustrated and described above are merely illustrative of the infinite variety of packages which can be made according to the present invention. Almost any shape can be made, giving full reign to the designer's imagination in achieving an esthetically pleasing package while still providing adequate freedom of orientation of the package on the merchandiser's shelf.

Packages according to the present invention can be fabricated from conventional materials utilized in the blister packaging art. The blisters can be thermoformed from any convenient thermoplastic material. Barrier properties (resistance to diffusion) may be provided by the use of an appropriate multi-layer thermoplastic laminate. Alternatively, the blisters may be cold-drawn from sheet aluminum.

A wide variety of materials may be utilized for the cover of a package according to the present invention. Merely by way of example, cardboard, paper, plastic film or aluminum foil can be used. However, for a cover such as that illustrated in FIG. 2, having a score line and hinge effect, the cover material should be relatively stiff. A coated cardboard may be used in this application. By contrast, if the cover must conform to a non-planar flanges and make relatively sharp bends in the transition from one flange to another, a relatively flexible material such as a plastic sheet or aluminum foil may be used to good advantage.

As numerous variations and combinations of the features shown above may be utilized without departing from the present invention, the foregoing description of the preferred embodiments should be understood by way of illustration rather than by way of limitation of the present invention as set forth in the claims.

We claim:

1. A package comprising:

(a) a unitary blister defining a cavity and having an opening to said cavity extending over two faces of said blister, and having two flanges extending outwardly from the remainder of the blister, at the periphery of said opening, one of said flanges being disposed at one of said faces, the other one of said flanges being disposed at the other one of said faces, each such flange defining a planar support for said blister, the planes of said supports angularly intersecting one another; and (b) a sheetlike cover closely overlying both of said flanges and overlying said opening.

2. A package as claimed in claim 1 in which said flanges intersect one another at an edge of said blister.

3. A package as claimed in claim 2 in which each of said flanges is generally U-shaped, the portions of said flanges corresponding to the tips of the U-shapes being the intersecting portions of said flanges.

4. A package as claimed in claim 2 or claim 3 in which the intersecting portions of said flanges define a chamfer at said edge.

5. A package as claimed in claim 1 in which one of said flanges has a hole formed therein for suspending the package from a peg.

6. A package as claimed in claim 1 in which said cover has a hole formed therein for suspending the package from a peg.

7. A package as claimed in claim 5 or claim 6 in which said package is elongated and has two opposite ends, a first one of said flanges being disposed at one of said ends, said hole being disposed adjacent the other one of said ends.

8. A package as claimed in claim 1 in which each of said flanges includes a planar portion, said planar portions defining said planar supports.

9. A package as claimed in claim 1 in which the planes of said supports intersect one another at an angle of between 80° and 100°.

10. A package as claimed in claim 1 in which said cover is releasably attached to at least a portion of one of said flanges.

11. A package as claimed in claim 10 further comprising means for temporarily retaining said cover in position overlying said opening after release of said releasable attachment.

12. A package as claimed in claim 10 in which said cover is releasably attached to both of said flanges.

13. A package as claimed in claim 1 in which said package has two opposite ends, one of said flanges being disposed at one of said ends, further comprising means for forming a discharge hole in said cover at a location adjacent the other one of said ends, so that said discharge hole is in communication with the space within the blister.

14. A package as claimed in claim 13 in which said blister has a pair of walls sloping toward one another in the vicinity of said location.

* * * * *